US005339542A

United States Patent [19]

Kim

[11] Patent Number: 5,339,542

[45] Date of Patent: Aug. 23, 1994

[54] FRONTAL SOLE EXERCISE DEVICE

[75] Inventor: John Y. Kim, Mountain View, Calif.

[73] Assignee: Metapro, Mountain View, Calif.

[21] Appl. No.: 65,314

[22] Filed: May 20, 1993

[51] Int. Cl.[5] ..... A43B 3/18

[52] U.S. Cl. ..... 36/7.2; 36/7.5; 36/132

[58] Field of Search ..... 36/7.2, 7.4, 81, 112, 36/7.5, 106, 132, 7.1 R, 88, 1, 77 R, 114

[56] References Cited

U.S. PATENT DOCUMENTS

| | | | |
|---|---|---|---|
| 2,268,435 | 12/1941 | Zucker | 36/7.5 |
| 3,012,343 | 12/1961 | Dinkel | 36/7.2 |
| 3,487,830 | 1/1970 | Pruett | 36/7.2 |
| 3,739,500 | 6/1973 | Cox . | |
| 3,829,990 | 8/1974 | Sakamoto . | |
| 3,889,400 | 6/1975 | Atzinger | 36/7.5 |
| 4,271,605 | 6/1981 | Rackza | 36/7.2 |
| 4,495,715 | 1/1985 | Fredrickson et al. | 36/7.2 |
| 4,707,934 | 11/1987 | Hart . | |
| 4,774,776 | 10/1988 | Gulli . | |
| 4,876,804 | 10/1989 | Hart . | |
| 5,075,984 | 12/1991 | Shiew | 36/81 |

OTHER PUBLICATIONS

Sport Shoes, Space-K, Dong Seo Ltd., World Space Ltd.

*Primary Examiner*—Paul T. Sewell
*Assistant Examiner*—Thomas P. Hilliard
*Attorney, Agent, or Firm*—LaRiviere & Grubman

[57] ABSTRACT

An exercise device for strengthening the muscles and ligaments of the feet, legs and lower torso. The device comprises a platform element, front and rear securing straps, a footbed and a tractive sole. The rear securing straps are attached substantially below the upper level of the platform element, helping to preclude inadvertent egress from the device while in use. The front securing straps are for substantially securing the forward portion of the foot to the device.

12 Claims, 4 Drawing Sheets

FRONTAL SOLE EXERCISE DEVICE

TECHNICAL FIELD

This invention relates to exercise equipment, in particular a frontal sole exercise device. The device is removably attachable to a human foot, including a wide variety of footwear. The device may be used for conditioning and strengthening muscles and ligaments of the wearer's feet, legs and lower torso.

BACKGROUND

To strengthen the muscles and ligaments of the lower body, it is known in physical education to perform exercises directed to hopping, running, jumping, lifting weights, etc. on the balls of the person's feet. In so doing, a person will strengthen many of the major muscle groups of the feet, legs and lower torso. The efficacy of these exercises is directly related to the amount of weight borne on the forward part of the foot of the user, and also directly related to the number of repetitions of each exercise so performed.

U.S. Pat. No. 3,739,500 to Cox describes a shoe, and the use thereof, with a platform integrally attached to the front of the shoe. In Cox, an exercise shoe having attached thereto a flexible pillar sole member for causing the wearer to stand, walk and run on the balls of the feet, thereby maximizing the effect and potential benefit of any repetitions performed. The benefits of training on elevated front foot shoes are well described in Cox. Many athletes prefer to obtain such benefits wearing their normal training shoes.

Cox alludes to the possibility of attaching his extension separately to conventional athletic shoes: "... the extension with its ground contacting sole may be separately manufactured and suitably attached to conventional athletic shoes." (column 2, lines 52–54) The challenge heretofore has been to attach platforms removably to the wearer's normal training shoes, such that they remain securely attached during rigorous running and jumping, yet are removable after use. The absence, so far, of a commercially successful separate shoe extension stems from the fact that a satisfactory design has proved elusive. If the platforms were to be attached securely enough, they had to be attached to the shoe with some degree of permanence, such as being glued onto the bottoms, or being bolted through holes drilled into the sole. If the platforms were to be attached removably enough, they were somehow strapped onto or tied to the shoe making them prone to shifting or slipping off during the course of vigorous exercise. The present invention offers a novel solution providing the functions of both secure attachment and easy removability.

The exercise shoe of Cox has several limitations: (1) it is an expensive piece of equipment, consisting of an entire shoe; (2) it is a size specific piece of equipment, a pair only usable by individuals having the same shoe size; (3) it is a complete shoe, the user of which cannot use the athletic shoe which he uses in competition while using the exercise shoe (this is to many athletes a significant problem in that to maximize their performance they prefer to train in the same shoes in which they compete); (4) it is a shoe which prevents training in one's bare feet (many athletes, particularly sprinters and distance runners prefer to exercise and compete in their bare feet); and (5) it is a bulky piece of equipment, requiring significant space allotment.

DISCLOSURE OF INVENTION

According to the present invention, a device for exercising the feet, legs and lower torso is disclosed. The frontal sole exercise device of the present invention employs easily removable means of attachment of the device to a variety of footwear, and may be used without any footwear. Securing the feet or footwear to the device of the present invention is by means of two sets of securing straps: one set securing the front portion of the feet and one set securing the rear portion of the feet. These two sets of straps in combination prevent any unwanted motion by the foot or footwear while using the device. The straps are adjusted and fastened by fastening means in operative combination with each of the several straps.

The platform element of the present invention is a firm, resilient material, which is resistant to compression while providing sufficient capability to absorb the shock created during use. The bottom surface of the platform element of the present invention is covered with a tractive sole to firmly grip the ground or other surface used during exercise. By attaching the rear securing strap to the bottom portion of the platform element, the tendency of the user's foot to lift away from the device while in use is reduced. The platform device has on its upper surface a footbed to receive the user's foot. By combining this footbed with the previously discussed securing straps, the device is usable by several users having a variety of different sized feet. Also, the exercise device of the present invention may be made of various colors and styles, e.g., neon colors, prints and other fashion statement means.

One feature of the present invention is the reverse angle of the rear edge of the platform element. Another feature is the thickness of the platform element. These features serve to ensure that substantially all the user's weight is borne upon the forward part of the foot.

Because the exercise device of the present invention is not built around an integral shoe, it is easier and less expensive to manufacture than the shoe of Cox. A further benefit of this configuration is that the exercise device of the present invention is therefore smaller than the shoe of Cox. Also, the present invention can be removably attached to a variety of footwear.

The exercise device of the present invention can improve the development of fast-twitch muscle fiber. The muscle fiber associated with actions requiring maximum effort of a short duration, such as sprinting and jumping.

To summarize, the benefits of training on elevated front foot shoes are well described by Cox. By approaching the same benefits in a different manner the present invention improves upon Cox in several important areas:

a. the present invention platforms are cheaper to build than an actual shoe with a molded-in sole platform, and thus can be sold at a more affordable cost to the consumer;
b. the present invention platforms will function when attached to any style shoe, e.g., running, court, crosstraining, aerobic, hightop, midtop or lowtop;
c. one pair of present invention platforms can be attached to accommodate shoes with minor size differences (plus/minus one whole size increment with the preferred embodiment), a shoe with integrally molded platforms, however, is inherently size specific, thereby offering no interchangeability for players on a team, different members of a family on a limited budget or youths with growing feet; and d. the present invention platforms are more compact to carry and store than platform molded shoes.

Other features of the present invention are disclosed or apparent in the section entitled "BEST MODE FOR CARRYING OUT THE INVENTION".

BRIEF DESCRIPTION OF DRAWINGS

For fuller understanding of the present invention, reference is made to the accompanying drawing in the following detailed description of the Best Mode for Carrying Out The Invention.

Figure 1:
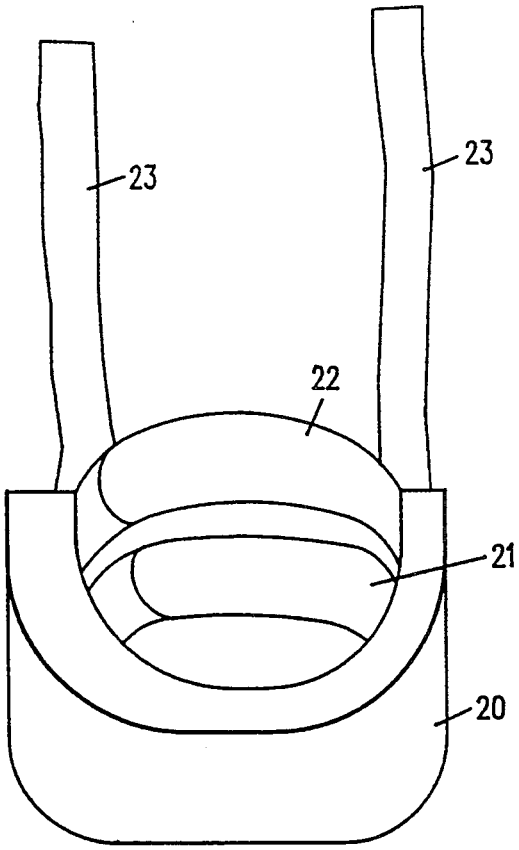
FIG. 1 is a front perspective view of the exercise device of the present invention, showing rear securing straps raised in the air.

Reference numbers refer to the same or equivalent parts of the present invention throughout the several figures of the drawing.

BEST MODE OF CARRYING OUT THE INVENTION

Referring to FIG. 1, a frontal sole exercise device comprises a platform element 20 having front securing straps 21, 22, and rear securing straps 23. The exercise device of the present invention may be removably attached to an item of footwear, to a naked human foot, or to a foot wearing an item of footwear, for instance an athletic shoe, a sock or both. While preferred use includes wearing a hightop athletic shoe, the present invention may be practiced with any style shoe, e.g., running, court, crosstraining, aerobic, midtop or lowtop.

Platform element 20 is centered substantially below the natural flex point of the foot coinciding with the ball of the foot, and causing substantially all the user's weight to be borne on the forward part of the foot, e.g., the distal portions of the metatarsals and those pedal structures distal thereto while the device is in use. With preferred use, none of the user's weight is borne upon the heel. This can also improve the mechanics of going off the toe and not the heel.

Platform element 20 in a preferred embodiment possesses sufficient thickness, resiliency and resistance to compression to substantially preclude contact between the heel area of the foot or of the footwear and the ground. A thickness of approximately two inches is sufficient for this purpose without causing the user to be so high as to create imbalance. In the preferred embodiment of the present invention, platform element 20 is composed of a monolithic block of resilient foam, for example polyethylene (manufactured under the tradename ethafoam). Alternative embodiments of platform element 20 of the present invention may be made of rubber, polyurethane, polyvinyl chloride, ethylene vinyl acetate (EVA), or any of several resilient compounds or substances well known to those skilled in the art. As an alternative to monolithic construction, platform element 20 may be fabricated with an internally hollow honeycomb core thereby maintaining rigidity and resistance to compression while reducing mass. However, the extra mass provided by the present invention at the front of the foot is useful for developing calf muscles.

Figure 11:
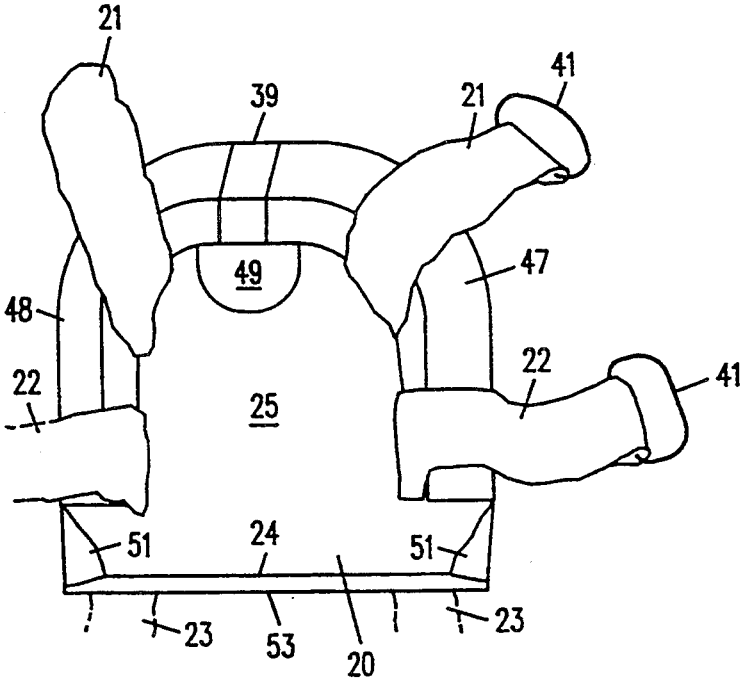

As indicated hereinabove, platform element 20 has affixed thereto means for securing a substantially forward portion of the foot to platform element 20. Securing may be accomplished through use of mechanical fasteners, laces, ties, or one or more straps. In the preferred embodiment of the present invention, front securing straps 21, 22 perform this function, thereby limiting the forward, lateral and horizontal torsional movements of the foot within the footbed, and further limiting inadvertent forward or upward egress of the foot from the exercise device while in use. In one embodiment, front securing straps 21, 22 comprise a hook and loop type material, and may further be provided with D-rings 41 (as shown in FIG. 11). Front securing straps 21, 22 may be attached through openings created in platform element 20.

As previously indicated, platform element 20 likewise has affixed thereto securing means for securing a substantially rearward portion of the foot to platform element 20. In the preferred embodiment of the present invention, substantially securing the rearward portion of the foot is accomplished with rear securing straps 23. Rear securing straps 23 are operable with front securing straps 21, 22 to further limit horizontal torsional movement of the footwear, while preventing inadvertent rearward egress of the foot from the exercise sole.

Figure 2:
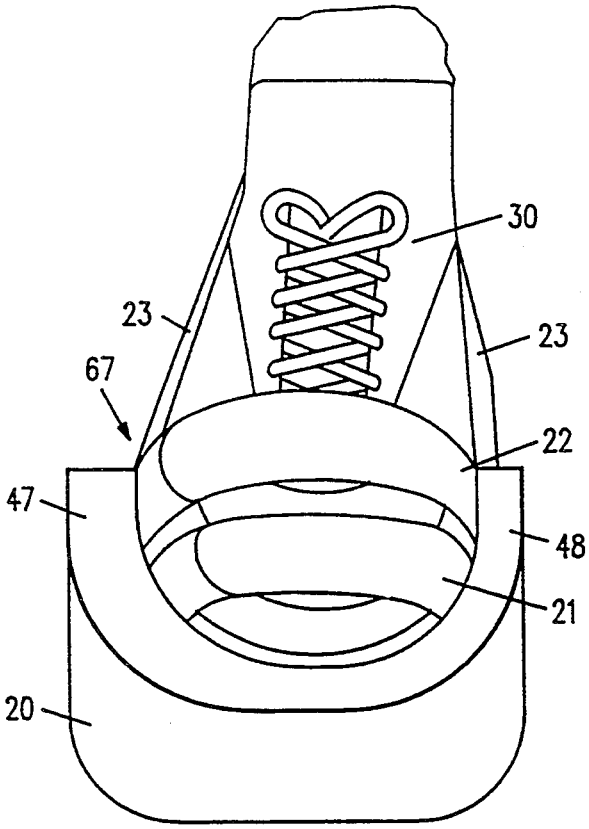
FIG. 2 is a front perspective view of the exercise device of FIG. 1 showing a shoe fastened therein.

Referring now to FIG. 2, there is shown an athletic shoe 30 fastened to the frontal sole exercise device of the present invention. It will be seen that front securing straps 21, 22 hold athletic shoe 30 securely in the platform element 20, while rear securing straps 23 wrap around the heel and cross over one another and fasten in front around the ankle.

Figure 3:
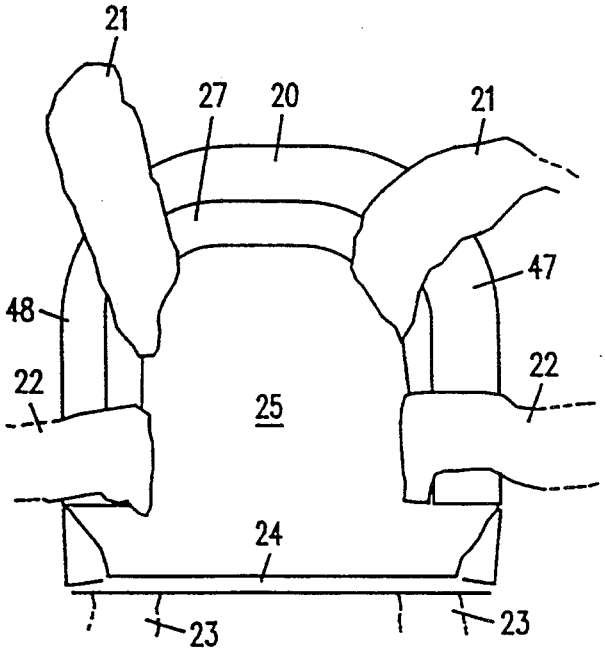
FIG. 3 is a rear perspective view of the exercise device of FIGS. 1 and 2.

Referring now to FIG. 3, front securing straps 21, 22 are fastened around the edges of platform element 20 adjacent footbed wall 27. Rear securing straps 23 may be attached at or near the rear edge 24 of platform element 20, substantially below upper surface 25 of platform element 20. This point of attachment enables normal flexion of the foot while ensuring that the exercise device rotationally follows the longitudinal flexion of the foot during use. By locating rear securing straps 23 at rear edge 24, shoe 30 is less likely to pull away from the exercise device of the present invention while in use.

It should be understood that upper surface 25 provides a substantially level surface, e.g., horizontal and thus substantially parallel to a level ground, for shoe 30. A level footbed reduces tilting forward by a user when using the exercise device of the present invention. As tilting forward is reduced, there is more resistance to rolling of the front of the foot. Thus, extra mass, in the form of resistance to rolling, is provided to the front of the foot. This provides for better training, especially for developing calf muscles.

Figure 4:
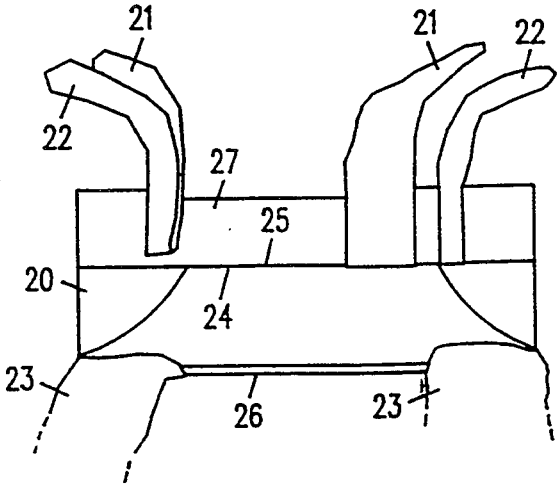
FIG. 4 is a rear elevation view of the exercise device of FIGS. 1–3.

FIG. 4 is a rear elevation view of the sole exercise device of the present invention. In this view, it will be apparent that rear securing straps 23 are fastened below upper surface 25 of platform element 20. In the preferred embodiment, rear securing straps 23 are configured to lie substantially flat against the foot, footwear and lower leg when fastened. Front securing straps and rear securing straps may comprise padding for more comfort, especially when using the exercise device of the present invention with bare feet or low cut shoes.

Rear edge 24 of platform element 20 tapers backwards and upwards, forming a reverse taper. Tractive sole 26, is shown as a separately formed element, attached to the bottom of platform element 20. Tractive sole 26 may be cemented, fused, glued, molded or otherwise attached to platform element 20. Alternatively, tractive sole 26 may alternatively be integrally formed with platform element 20 through molding, vacuum forming, machining or other processes well known in the art. Tractive sole may comprise ridges, a "waffle" pattern, cleats, or other well known surfaces for footwear.

Front securing straps 21, 22, as well as rear securing straps 23, are shown in their unfastened or separated configuration in FIGS. 3 and 4. Upper surface 25 of platform element 20 and footbed wall 27 combine to form the footbed for receiving the foot and footwear. Front securing straps 21, 22 are separately fastenable and adjustable for different footwear (or feet) or different sizes thereof (within a range of sizes) through the use of fastening means. The preferred embodiment of the present invention can be used within plus or minus one and one-half sizes, inclusive, of the user's shoe size and still be adjusted to be sufficiently snug for use.

Figure 10:
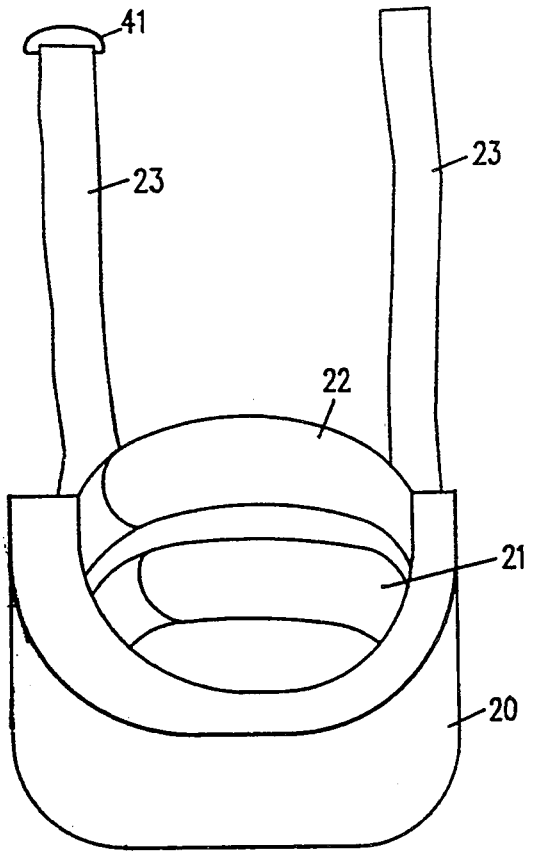
FIGS. 10–11 are alternate embodiments of the present invention as shown in FIGS. 1 and 3, respectively.

As mentioned elsewhere herein, in the preferred embodiment of the present invention, this fastening means comprises hook and loop material applied to each of front securing straps 21, 22. In the one embodiment, hook and loop tape is used. To adjust and fasten front securing straps 21, 22, the hook material portion of each strap is pressed together with its corresponding loop material portion on the same strap in a manner well known in the art. In the preferred embodiment of the frontal sole exercise device of the present invention, rear securing straps 23 also comprise hook and loop material. In one embodiment, rear securing straps are made of hook and loop tape. Additionally, rear securing straps 23 may include at least one D-ring 41 (as shown in FIG. 10). Alternatively, buckles, ratchet fasteners, paired D-rings, snaps, separable rivets, laces or other means well known to those skilled in the art may be used as fastening means for either the forward or rear securing straps, if desired. In one embodiment, front securing straps 21, 22 and rear securing straps 23 are made of a polypropylene material and comprise hook and loop material.

Referring again to FIG. 3, a means for receiving a substantial forward portion of the foot is shown as an indented footbed, comprising footbed wall 27 and upper surface 25 of platform element 20 in combination. The footbed receives the foot, positioning it upon upper surface 25 of platform element 20 and prevents inadvertent forward egress of the foot therefrom. In the preferred embodiment of the present invention, the footbed is formed by attaching footbed wall 27, made of polyethylene to the upper surface 25 of platform element 20 by means of hot glue. Alternatively, the footbed could be integrally formed with platform element 20 by means of machining, casting, vacuum forming or other process well known to those skilled in the art. It should be noted that outer portion 47 of wall 27 is thicker than inner portion 48. Outer portion refers to the wall extending along the outside of the foot or footwear. For example, in FIG. 2, a right shoe 30 is shown. Right shoe 30 has outer portion 47 aligned with the outer portion 67 of the right shoe 30. The additional thickness is added for structural integrity and to resist twisting out by the foot while in use. Thus, the user may push off against outer portion 48. Having a relatively thick wall 27 allows for greater lateral and longitudinal stability. Additionally, it should be understood that platform element 20 and wall 27 can be integrally made together such as to alternatively form a recessed footbed disposed in upper surface 25.

Figure 5:
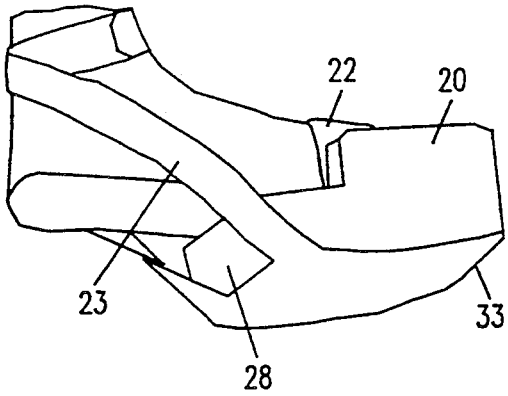
FIG. 5 is a bottom oblique perspective view of the exercise device of FIGS. 1–3.
Figure 6:
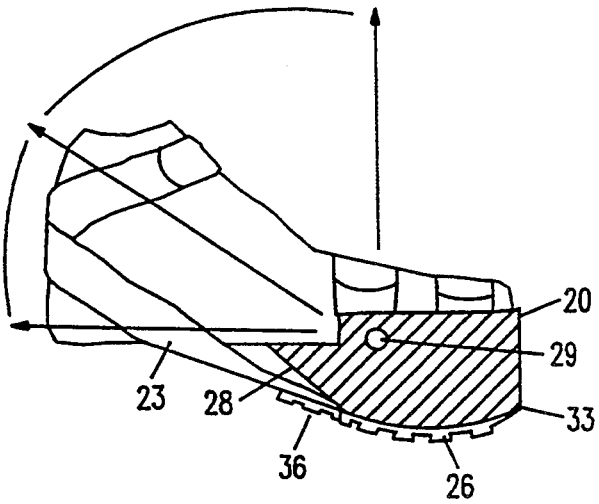
FIG. 6 is a cutaway side elevation view of a platform element of the exercise device shown in FIGS. 1–5, having an item of footwear attached, and showing the relationship between the point of flexion of the footwear and the platform element of the exercise device.

FIGS. 5 and 6 show rear bevel 28 and forward curve 33 of platform element 20. In addition, FIG. 6, which is a cutaway side elevation view, shows the tractive sole 26. FIG. 6 also shows the relationship between the point of flexion of the footwear and platform element 20 of the frontal sole exercise device of the present invention. Additionally, flap 36 of tractive sole 26 may be used with the present invention. Flap 36 provides mitigation of damage to rear securing straps 23.

Figure 7:
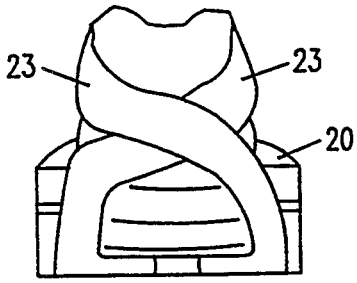
FIG. 7 is a rear elevation view of the exercise device of the present invention attached to an athletic shoe.

To use the exercise device of the present invention, front securing straps 21, 22 and rear securing straps 23 may be sufficiently loosened or unfastened as shown in FIG. 4, to permit insertion of a foot. The foot is inserted into the footbed and the forward straps tightened and fastened as shown in FIG. 5. Referring to FIG. 7, rear securing straps 23 are brought around the heel, and crossed over one another at the Achilles tendon area at the rear of the foot. Rear securing straps 23 are then wrapped around the ankle substantially above the ankle bone, e.g., the internal and external malleoli of the tibia and fibula, respectively, and fastened together by pressing the hook material with the loop material of rear securing straps 23 in a manner well known in the art.

Referring to FIG. 6, natural flex point 29 at the ball of the foot is shown. The attachment point of rear securing strap 23, originating as it does substantially below the plane of upper surface 25 of platform element 20 is likewise evident.

Figure 8:
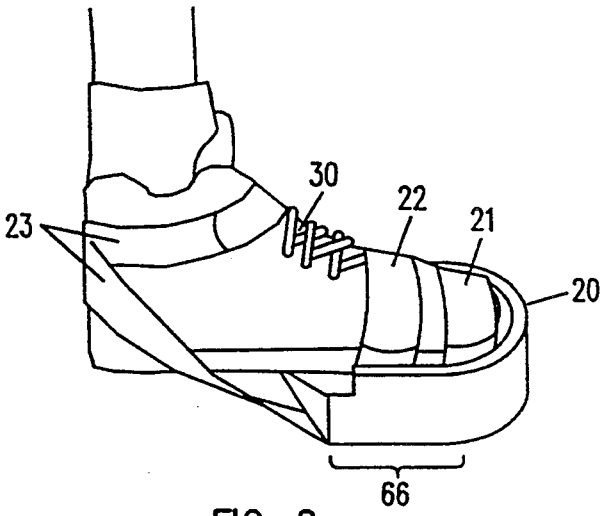
FIG. 8 is a right perspective view of the exercise device attached to an athletic shoe.
Figure 9:
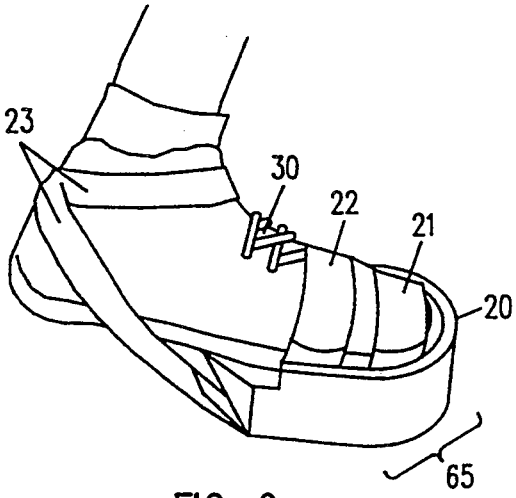
FIG. 9 is a right perspective view of the exercise device attached to an athletic shoe while in use, toward the end of a stride.

After donning the exercise device of the present invention (usually, but not necessarily in pairs, one per foot) in the manner previously described, various exercises or training regimens are conducted to strengthen and condition the muscles of the lower body. FIG. 8 is a right perspective view of the exercise device attached to an athletic shoe. FIG. 9 is a right perspective view of the exercise device attached to an athletic shoe illustrating it in use, near the end of a stride.

As illustrated in FIGS. 8 and 9, the fact that rear securing straps 23 extend from below upper surface 25 of platform element 20 to the ankle minimizes the tendency of the foot to pull away from the platform element 20 during use, as the foot flexes longitudinally about its natural flex point 29 (shown in FIG. 6). Also, ground plane of contact 66 is to be distinguished in the preferred embodiment from the ground arcuate contact 65. Rear securing straps 23 may be attached to platform element 20 near ground plane of contact 66, or further near both ground plane of contact 66 and arcuate contact 65.

As shown in FIGS. 10–11, front securing straps 21, 22 may each comprise at least one D-ring 41, and rear securing straps 23 may comprise at least one D-ring 41. Also, as is known, more than one ring may be used to tighten and maintain attachment of a shoe to the present invention. Additionally, platform element 20 may comprise inward contour 51 for narrowing. In which case, rear edge 24 is narrower than opposing bottom edge 53. Additionally, a bladder 49, e.g., an air bladder may be used with the present invention. Also, a pump 39 may be coupled to bladder 49 for increasing the pressure in the bladder.

Figure 12:
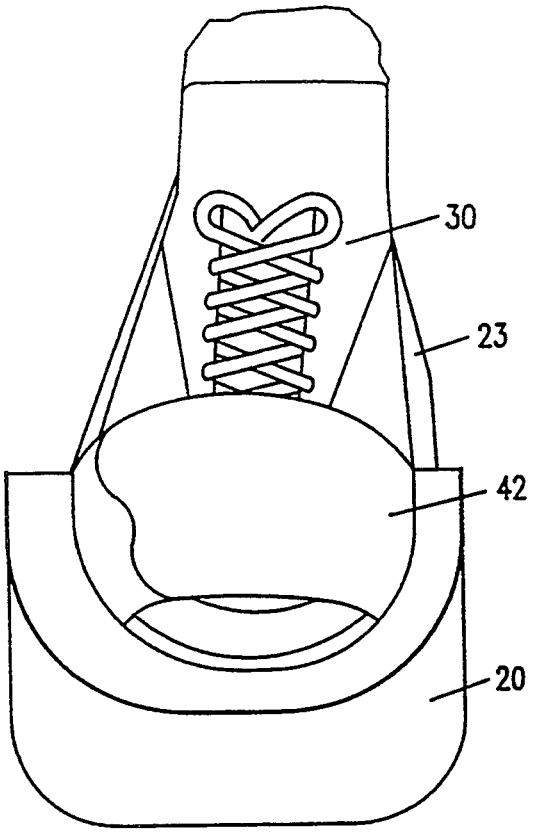
FIG. 12 is an alternate embodiment of the present invention as shown in FIG. 2.

As shown in FIG. 12, a single front securing strap 42 may be used. Front securing strap 42 may comprise a hook and loop type material, with or without a D-ring 41. Alternatively, front securing strap 42 may comprise other well known means for fastening.

Figure 13:
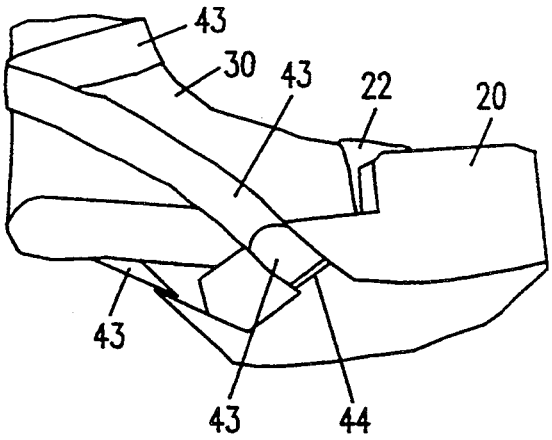
FIGS. 13–14 are alternate embodiments of the present invention as shown in FIGS. 5 and 8, respectively.
Figure 14:
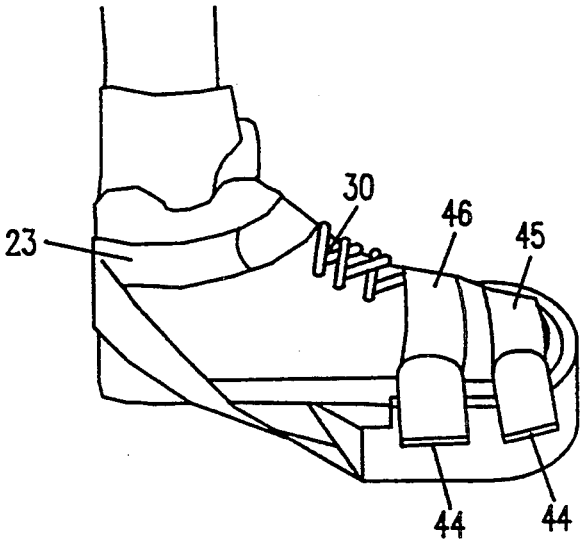

As shown in FIGS. 13–14, platform element 20 may include one or more openings 44. An opening 44 allows a strap to be inserted into one end and out another end of opening 44. In this manner front securing straps 45, 46 and rear securing strap 43 may each be made of a single continuous strip. These straps can comprise hook and loop type material or other fastening means known in the art.

Figure 15:
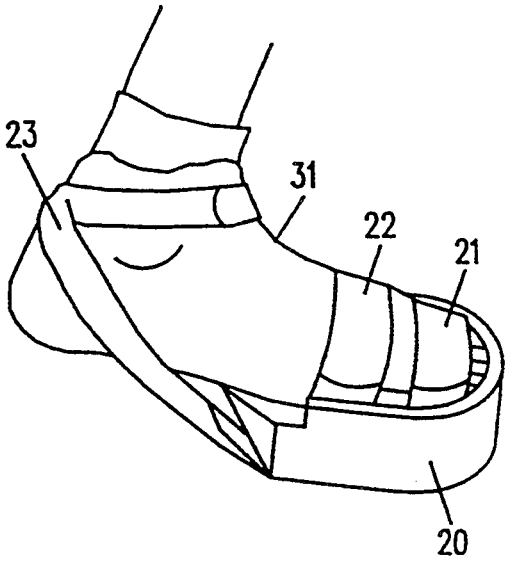
FIG. 15 shows use of the present invention with a bare foot.

As shown in FIG. 15, a bare foot 31 may be used with the present invention. Some athletes prefer to train in bare feet. Thus, the present invention teaches that bare feet may be used while practicing the art as taught by the present invention.

The present invention has been particularly shown and described with respect to certain preferred embodiments of features thereof. However, it should be readily apparent to those of ordinary skill in the art that various changes and modifications in form and detail may be made without departing from the spirit and scope of the invention as set forth in the appended claims. The invention illustratively disclosed herein may be practiced without any element which is not specifically disclosed herein.

What is claimed is:

1. A frontal sole exercise device for removably attaching to a user's foot disposed in footwear, the footwear having a forward and a rearward portion, the exercise device comprising:

a platform element having an upper and a lower surface, the upper surface of the platform element for receiving the forward portion of the footwear, the lower surface including a tractive sole, the upper surface including a footbed for receiving the forward portion of the footwear, the footbed having a wall, the wall having an inner portion and an outer portion, the outer portion being thicker than the inner portion, the footbed being substantially horizontally level, the platform element having sufficient thickness for causing weight of the user to be borne by the forward portion of the footwear when removably attached to the exercise device, the platform element having a width wider than the widest width of the forward portion of the footwear, the platform element being approximately half to one-third the length of the footwear;

at least one front strap affixed to the platform element for removably attaching the forward portion of the footwear to the upper surface, the front strap including at least one fastening means in operative combination with the front strap for adjusting the length of the front strap for removably attaching the forward portion of the footwear to the platform element; and at least one rear strap affixed to the platform element for removably attaching the rearward portion of the footwear to the platform element, the rear strap including at least one of the fastening means in operative combination with the rear strap for adjusting the length of the rear strap for removably attaching the rearward portion of the footwear to the platform element;

the footwear removably attached to the exercise device with the front strap and the rear strap for causing weight of the user to be borne by the forward portion of the footwear.

2. The exercise device of claim 1 wherein platform element includes a rearward bevel, the rearward bevel being sloped upward from the lower surface toward the upper surface of the platform element.

3. The exercise device of claim 1 wherein the platform element includes at least one opening defined therein.

4. The exercise device of claim 1 wherein the fastening means includes a ring.

5. The exercise device of claim 1 wherein the platform element is made of ethylene vinyl acetate.

6. The exercise device of claim 1 wherein the fastening means comprises hook and loop type material.

7. The exercise device of claim 1 wherein the rear strap is affixed to the platform element substantially below the upper surface of the platform element.

8. A frontal sole exercise device for removably attaching to a user's foot disposed in footwear, the footwear having a forward and a rearward portion, the exercise device for contact with a ground plane, the exercise device comprising:

a platform element having an upper and a lower surface, the upper surface of the platform element for receiving the forward portion of the footwear, the upper surface including a footbed for receiving the forward portion of the footwear, the footbed including a wall, the wall having an inner portion and an outer portion, the outer portion thicker than the inner portion, the footbed being horizontally level, the platform element having sufficient thickness for causing weight of the user to be borne by the forward portion of the footwear when removably attached to the exercise device, the platform element including a bevel, the bevel sloped upward from the lower surface toward the upper surface, the platform element having a width wider than the widest width of the forward portion of the footwear, the platform element being approximately half to one-third the length of the footwear;

pairs of front straps affixed to the platform element for removably attaching the forward portion of the footwear to the upper surface, the pairs of front straps each including at least one first ring in operative combination with the pairs of front straps for individually adjusting the length of each of the pairs of front straps for removably attaching the forward portion of the footwear to the platform element;

one pair of rear straps affixed to the platform element for removably attaching the rearward portion of the footwear to the platform element, the pair of rear straps including at least one second ring in operative combination with the pair of rear straps for adjusting the length of the pair of rear straps for removably attaching the rearward portion of the footwear to the platform element, the one pair of rear straps being attached to the platform element near a ground plane of contact between the platform element and the ground plane; and a tractive sole attached to the lower surface of the platform element;

the footwear removably attached to the exercise device with the front strap and the rear strap for causing weight of the user to be borne by the forward portion of the footwear.

9. The exercise device of claim 8 wherein the pairs of front straps and the pair of rear straps each comprise hook and loop type material.

10. The exercise device of claim 8 wherein the pair of rear straps are affixed to the platform element substantially below the upper surface of the platform element.

11. The exercise device of claim 8 wherein the tractive sole is formed integrally with the platform element.

12. The exercise device of claim 8 wherein the platform element is made of polyethylene, and the tractive sole is made of rubber.

* * * * *